US005927596A

United States Patent [19]

Trenier

[11] Patent Number: 5,927,596

[45] Date of Patent: Jul. 27, 1999

[54] MAIL BOX INCLUDING A VISUAL DEPOSIT INDICATOR

[76] Inventor: Jerome C Trenier, 2251 Demetropolis Rd., Mobile, Ala. 36693

[21] Appl. No.: 09/107,430

[22] Filed: Jun. 30, 1998

[51] Int. Cl.[6] ..... B65D 91/00

[52] U.S. Cl. ..... 232/35; 232/17

[58] Field of Search ..... 232/35, 34, 17, 232/45

[56] References Cited

U.S. PATENT DOCUMENTS

| | | | |
|---|---|---|---|
| 2,864,553 | 12/1958 | Petrie | 232/35 |
| 3,026,025 | 3/1962 | Hanson | 232/35 |
| 3,291,386 | 12/1966 | Fleet | 232/35 |
| 3,318,516 | 5/1967 | Scheerer | 232/35 |
| 3,606,141 | 9/1971 | Taylor | 232/35 |
| 3,675,845 | 7/1972 | Scheerer | 232/35 |
| 4,000,847 | 1/1977 | Duis | 232/35 |
| 4,706,880 | 11/1987 | Peters | 232/35 |
| 5,201,465 | 4/1993 | Limehouse | 232/35 |
| 5,366,148 | 11/1994 | Schrekengost | 232/35 |

*Primary Examiner*—Brian K. Green
*Assistant Examiner*—William L. Miller
*Attorney, Agent, or Firm*—Michael I. Kroll

[57] ABSTRACT

A mailbox including a visual deposit indicator for alerting a user that the mailbox has been opened. The mailbox includes a housing having a hollow inner side and an open face side and a door pivotally connected to the housing for selectively covering the open face side. A visual signaling device is pivotally connected to the housing on a side opposite the door. A device for releasably engaging the visual signaling device extends through the housing and is fastened to and movable with the door. The visual signaling device is movable between a first inactivated position in which the door is pivoted to cover the open face side and the device for releasably engaging engages the visual signaling device thereby retaining the visual signaling device in a position blocked from view by the housing and a second activated position in which the door is pivoted to provide access to the open face side causing the device for releasably engaging to become disengaged from the visual signaling device and allowing the visual signaling device to pivot into a visible position unblocked by the housing. The device for releasably engaging is the form of a rod and the visual signaling device includes a recess extending therethrough for receiving the rod when in the first inactivated position. A rod cover is fastened within the inner side of the housing, the rod being slidable therethrough. A rod guide is secured between the rod cover and back side of the mailbox for guiding the rod.

2 Claims, 6 Drawing Sheets

MAIL BOX INCLUDING A VISUAL DEPOSIT INDICATOR

BACKGROUND OF THE INVENTION

1. Field of the Invention

The present invention relates generally to mail boxes and, more specifically, to a mailbox including a device for providing a visual indication that the mail box has been opened for depositing items therein.

2. Description of the Prior Art

Numerous types of mailboxes and indicators for alerting a user that items such as mail have been deposited in the mailbox have been provided in the prior art. While these mailboxes and indicators for alerting a user that items such as mail have been deposited in the mailbox may be suitable for the particular purpose to which they address, they would not be as suitable for the purposes of the present invention as heretofore described.

It is thus desirable to provide a mailbox including a visual deposit indicator on a rear side thereof and able to be viewed from a great distance. It is further desirable to provide a mailbox including a visual deposit indicator which operates automatically upon opening of the mailbox to alert a user that the mailbox has been opened and therefore does not require any additional action on the part of the person opening the mailbox and depositing the item.

SUMMARY OF THE PRESENT INVENTION

The present invention relates generally to mail boxes and, more specifically, to a device for providing a visual indication that the mail box has been opened for depositing items therein.

A primary object of the present invention is to provide a mailbox including a visual deposit indicator that will overcome the shortcomings of prior art devices.

Another object of the present invention is to provide a mailbox including a visual deposit indicator which is able to alert an owner of the mailbox that the mailbox has been opened to place an item therein.

A further object of the present invention is to provide a mailbox including a visual deposit indicator which is able to automatically activate upon opening of a door to the mailbox.

A yet further object of the present invention is to provide a mailbox including a visual deposit indicator wherein the visual indicator is positioned to extend from a rear side of the mailbox.

A still further object of the present invention is to provide a mailbox including a visual deposit indicator wherein the visual indicator is activated by the force of gravity.

A further object of the present invention is to provide a mailbox including a visual deposit indicator able to be viewed from a great distance.

Another object of the present invention is to provide a mailbox including a visual deposit indicator that is simple and easy to use.

A still further object of the present invention is to provide a mailbox including a visual deposit indicator that is economical in cost to manufacture.

Additional objects of the present invention will appear as the description proceeds.

A mailbox including a visual deposit indicator for alerting a user that the mailbox has been opened is disclosed by the present invention. The mailbox includes a housing having a hollow inner side and an open face side and a door pivotally connected to the housing for selectively covering the open face side. A visual signaling device is pivotally connected to the housing on a side opposite the door. A device for releasably engaging the visual signaling device extends through the housing and is fastened to and movable with the door. The visual signaling device is movable between a first inactivated position in which the door is pivoted to cover the open face side and the device for releasably engaging engages the visual signaling device thereby retaining the visual signaling device in a position blocked from view by the housing and a second activated position in which the door is pivoted to provide access to the open face side causing the device for releasably engaging to become disengaged from the visual signaling device and allowing the visual signaling device to pivot into a visible position unblocked by the housing. The device for releasably engaging is the form of a rod and the visual signaling device includes a recess extending therethrough for receiving the rod when in the first inactivated position. A rod cover is fastened within the inner side of the housing, the rod being slidable therethrough. A rod guide is secured between the rod cover and back side of the mailbox for guiding the rod.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
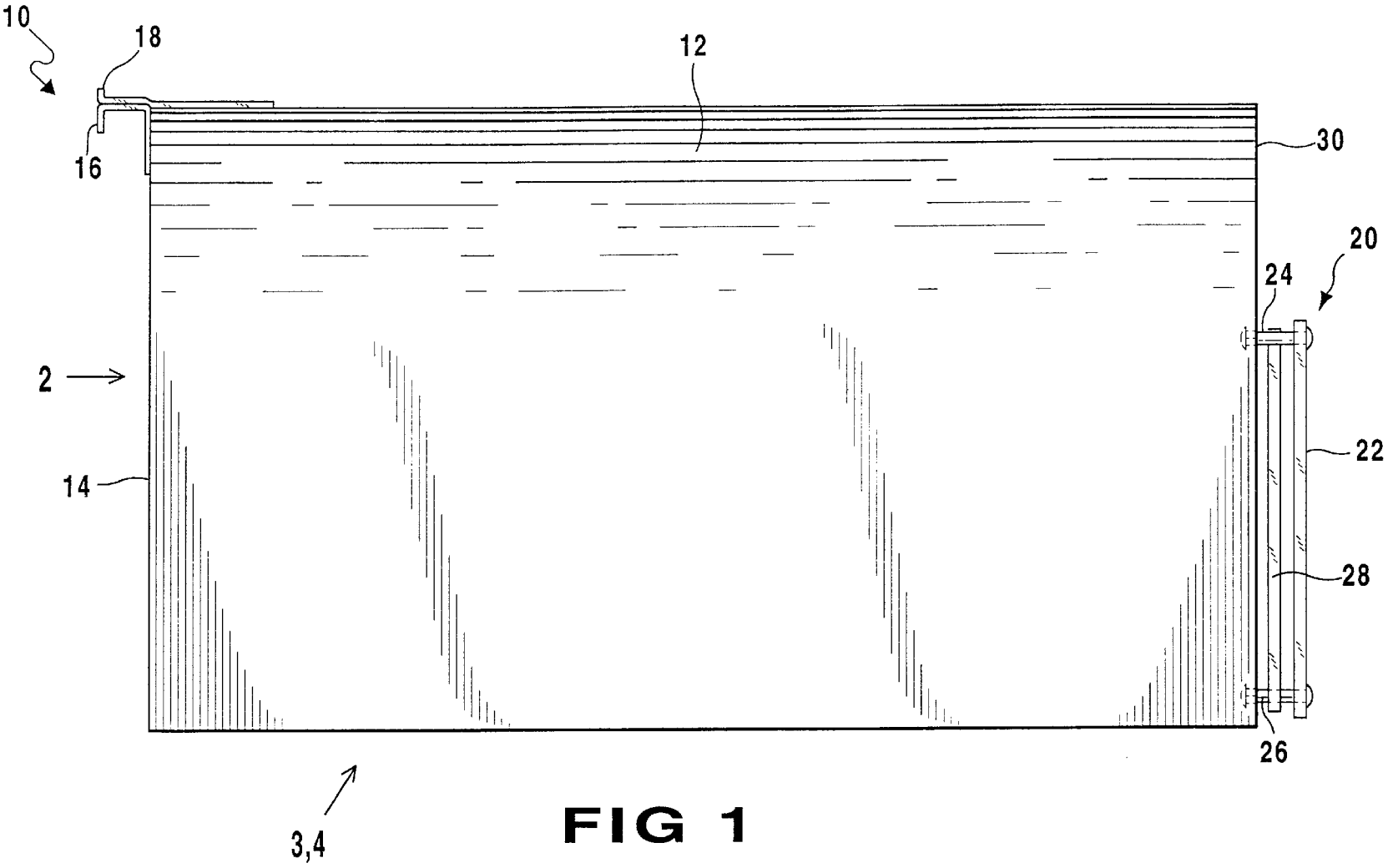
FIG. 1 is a side view of the mailbox including a visual deposit indicator of the present invention.

Turning now descriptively to the drawings, in which similar reference characters denote similar elements throughout the several views, the Figures illustrate the mailbox including a visual deposit indicator of the present invention. With regard to the reference numerals used, the following numbering is used throughout the various drawing figures.

10 mailbox including a visual deposit indicator of the present invention
12 housing forming the mailbox
14 front door of the mailbox
16 clamp secured to front door of mailbox
18 clamp secured to housing of mailbox
20 visual indicator
22 cover plate of visual indicator
24 first fastener securing cover plate to mailbox
26 second fastener securing cover plate to mailbox
28 visual signaling device
30 back side of mailbox
32 inner side of housing
34 activation mechanism
36 inner side of front door
38 recess in back side of housing
40 rod
42 fastening device securing rod to inner side of front door
44 rod cover
45 rod guide
46 securing device retaining rod guide in position within the housing
47 connection between rod cover and rod guide
48 end of rod engaging visual signaling device
50 arrow indicating pivoting of front door into open position
52 arrow indicating pivoting of visual signaling device when front door is opened
54 message on visual signaling device
56 recess extending through visual signaling device from engaging rod
58 arrow indicating direction of movement of rod

DETAILED DESCRIPTION OF THE PREFERRED EMBODIMENT

Turning now descriptively to the drawings, in which similar reference characters denote similar elements throughout the several views, FIGS. 1 through 6 illustrate the mailbox including a visual deposit indicator of the present invention indicated generally by the numeral 10.

The mailbox including a visual deposit indicator 10 is shown in FIG. 1 and includes a main housing 12 for receiving items such as mail and a front door 14 for accessing an inner side of the housing 12 to deposit items therein. The front door 14 is pivotally connected to the housing 12 for releasably closing an entry to the housing 12. A preferred mechanism for releasably latching the front door and preventing access to the inside of the housing 12 includes a first clasp 16 connected to the front door 14 and a second clasp 18 for releasably mating with the first clasp 16 connected to and extending from the housing 12. When the front door 14 is pivoted to close access to the housing 12, the first and second clasps 16 and 18 are caused to mate with each other and retain the front door 14 in a closed position as shown in FIG. 1.

While a preferred mechanism for releasably sealing access to the mailbox is shown and described herein, those of ordinary skill in the art who have read the description will appreciate that there are numerous other mechanisms for releasably sealing access to the mailbox and, therefore, as used herein the phrase "means for releasably sealing access to the mailbox" should be construed as including all such mechanisms as long as they achieve the desired result of releasably sealing access to the mailbox, and, therefore, that all such equivalent mechanisms are to be considered as equivalents to the one described herein.

Positioned on a side of the housing 12 opposite the front door 14 is the visual deposit indicator 20. The visual deposit indicator 20 includes a cover plate 22 secured to the housing 12 by first and second fasteners 24 and 26, respectively. A visual signaling device 28 is positioned between the cover plate 22 and a back side 30 of the housing 12. The visual signaling device 28 is pivotally connected to the second fastener 26 and releasably secured in place by an activation mechanism as will be described in detail hereinafter.

Figure 2:
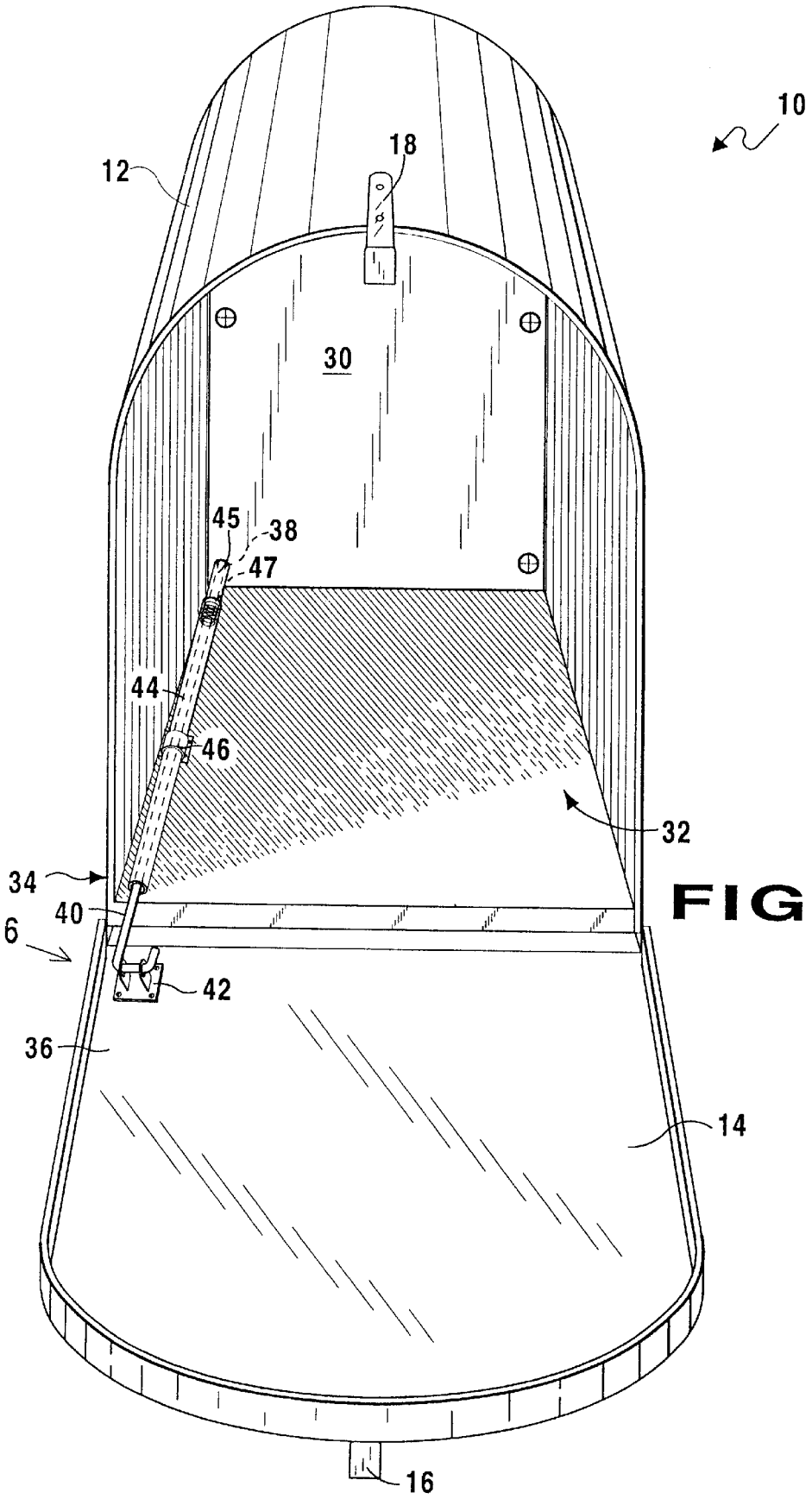
FIG. 2 is a front perspective view of the mailbox including a visual deposit indicator of the present invention, the front door of the mailbox being in an open position.

FIG. 2 illustrates a front view of the mailbox including the visual deposit indicator 10 with the front door 14 in an unlatched position to show an inner side 32 of the housing 12. As can be seen from this view, the activation mechanism 34 is secured to an inner side 36 of the front door 14 and extends through the inner side 32 of the housing 12. A recess 38 is formed in the back side 30 of the housing 12 through which the activation mechanism 34 extends. The activation mechanism 34 includes a rod 40 having a length greater than the length of the housing 12 secured to the inner side 36 of the front door 14 by a fastening device 42. A rod cover 44 also extends through the inner side 36 of the housing 12 and is secured within the inner side 36 of the housing 12 by a securing device 46. The rod 40 is positioned to extend through the rod guide 44 and slide therethrough when the front door 14 is pivoted as will be described hereinafter. Connected between the rod cover and the back side 30 of the housing 12 is a rod guide 45. The rod guide 45 is secured at one end to the back side 30 of the housing 12 and surrounds the recess 38. At the opposite end, the rod guide 45 is connected to the rod cover 44 by a connection device 47. In the embodiment illustrated the rod guide 45 and rod cover 44 are secured by interengaging threads on both the rod guide 45 and rod cover 44. However, any device for securing the rod guide 45 and rod cover 44 may be used. The rod guide 45 and rod cover 44 may even be formed as a single element. The rod 40 also extends through the rod guide 45 and is aligned with the recess 38 thereby. The circumference of the rod guide 45 is slightly larger than the circumference of both the rod 40 and the recess 38 thereby eliminating the possibility of the rod 40 and recess 38 being misaligned.

Figure 3:
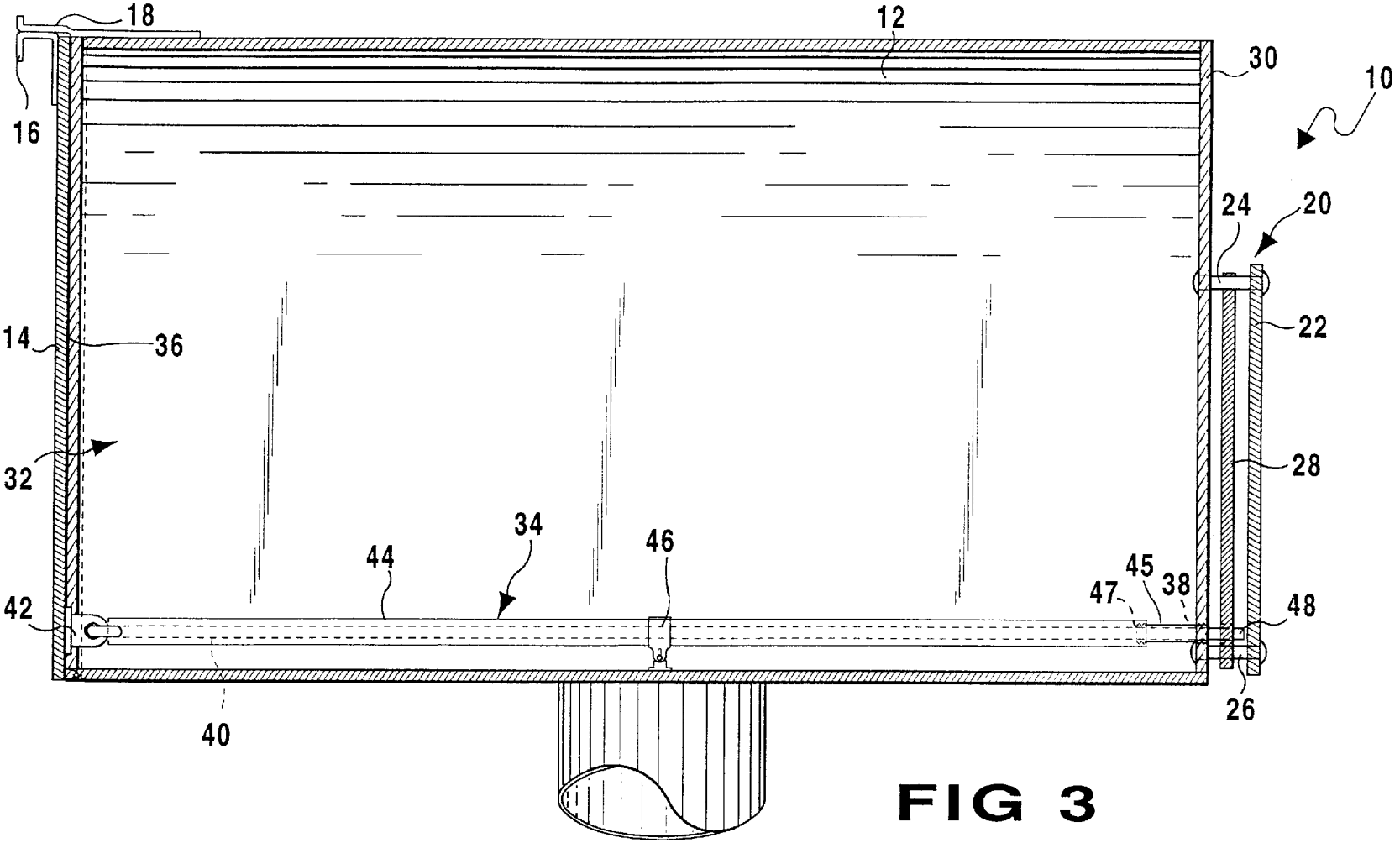
FIG. 3 is a side cross-sectional view of the mailbox including a visual deposit indicator of the present invention.

A side cross-sectional view of the mailbox including the visual deposit indicator 10 is illustrated in FIG. 3 showing the activation mechanism 34 extending through the housing 12 and the visual signaling device 28 in the inactivated mode. As can be seen from this figure, the rod 40 is secured to the inner side 36 of the front door 14 by the fastening device 42 and extends through the inner side 32 of the housing 12 and the recess 38. The rod cover 44 is secured within the inner side 32 of the housing 12 and is connected to the rod guide 45 which is secured to the back side 30 and surrounds the recess 38. The rod 40 is slidably positioned to extend through the rod cover 44, the rod guide 45 and the recess 38. The rod cover 44 acts to prevent any items contained within the housing 12 from contacting the rod 40 and being effected by the sliding movement of the rod 40. The rod guide 45 retains the rod 40 and the recess 38 in alignment.

In the inactivated position an end 48 of the rod 40 extends past the back side 30 of the housing 12. The end 48 of the rod 40 engages the visual signaling device 28 when the front door 14 is in the closed position to retain the visual signaling device 28 in the inactive mode. In this position the visual signaling device 28 has been pivoted to be positioned between the back side 30 and the cover plate 22 and the front door 14 has been pivoted to the closed position. This causes the rod 40 to be slid through the recess 38 and engage the visual signaling device 28 preventing the visual signaling device 28 from pivoting.

Figure 4:
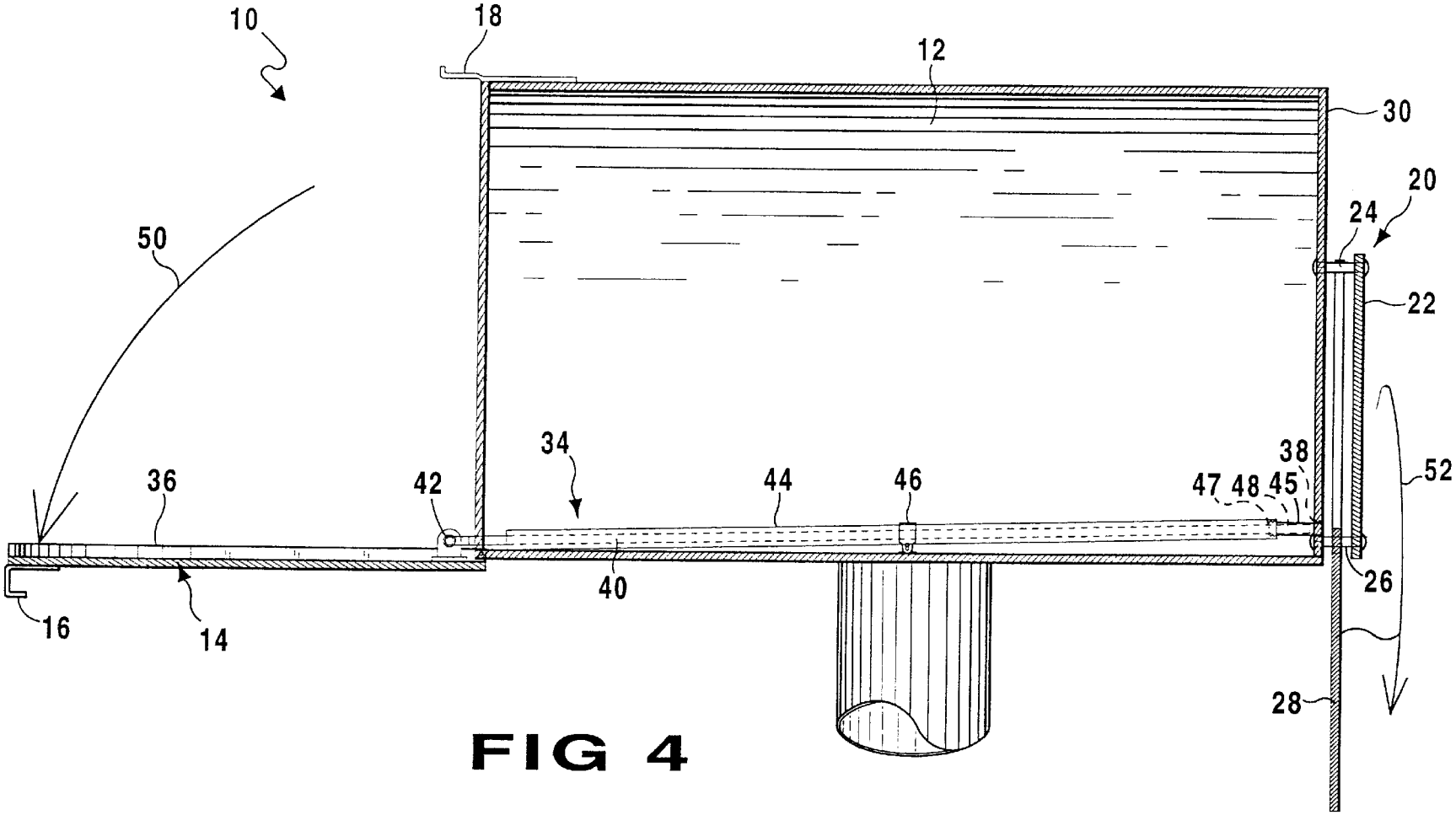
FIG. 4 is a side cross-sectional view of the mailbox including a visual deposit indicator of the present invention, the front door of the mailbox being in the open position and the visual indicator being activated.

A side cross-sectional view of the mailbox including the visual deposit indicator 10 is illustrated in FIG. 4 showing the activation mechanism 34 extending through the housing 12 and the visual signaling device 28 in the activated mode. As can be seen from this figure, the door 14 has been pivoted into the open position as indicated by the arrow labeled 50. The pivoting of the door 14 causes the fastening device 42 to move with the door 14 and thus also causes the rod 40 secured thereto to slide with the door 14. The rod 40 is caused to slide through the rod guide 45 and rod cover 44 whereby the end 48 of the rod 40 is caused to slide through the recess 38 and into the inner side 32 of the housing 12. As the end 48 of the rod 40 slides into the inner side 32 of the housing 12, its engagement with the visual signaling device 28 is released allowing the visual signaling device 28 to pivot about the second fastener 26 due to the force of gravity and into the activated position. The pivoting of the visual signaling device is indicated by the arrow labeled 52. The pivoting of the visual signaling device 28 into the activated position causes it to come to rest extending below the housing 12 and thus become visible to persons viewing the mailbox. The visibility of the visual signaling device 28 is an indication that the front door 14 has been pivoted to the open position and therefore that an item has been placed therein.

Figure 5:
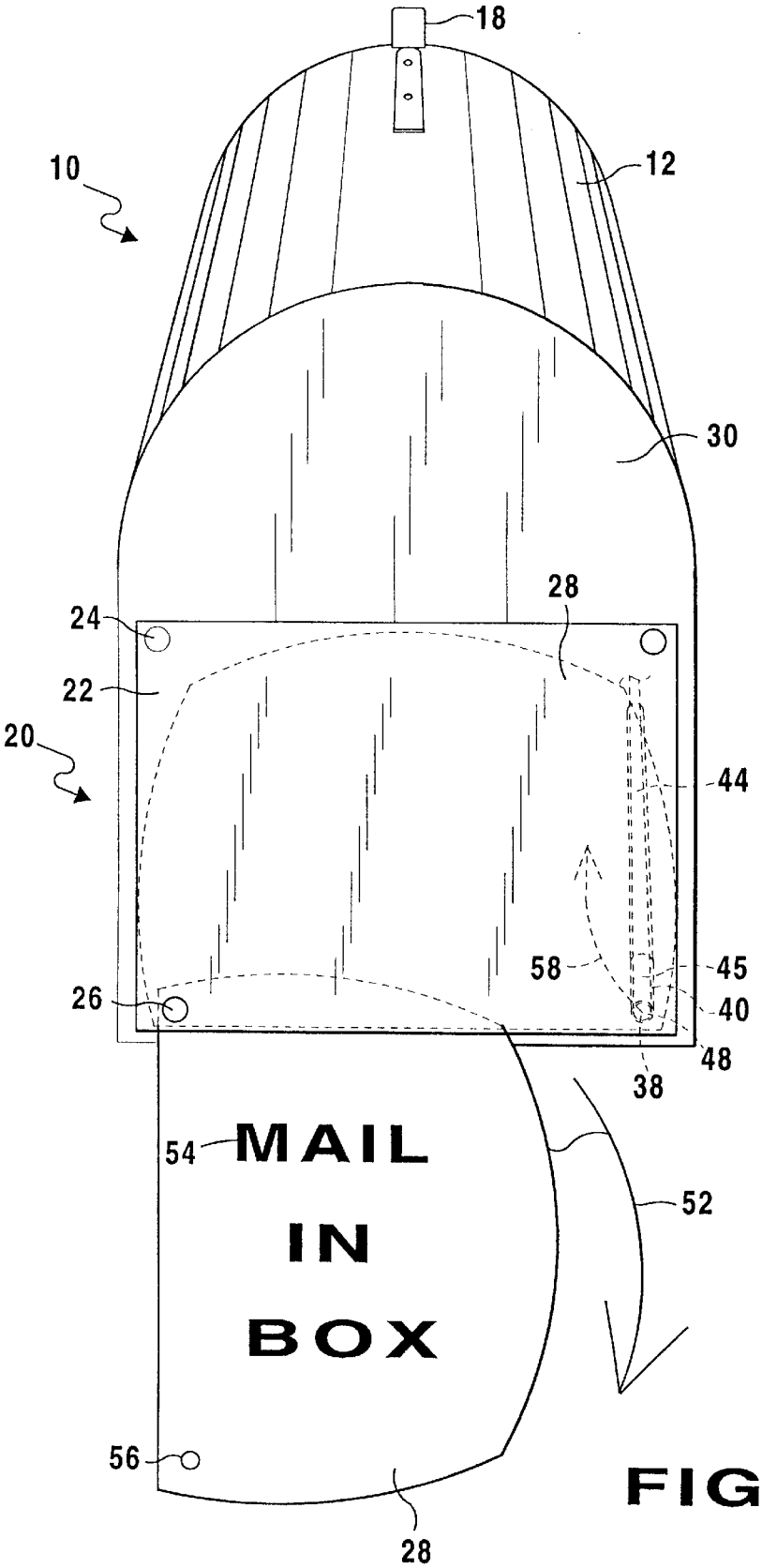
FIG. 5 is a rear perspective view of the mailbox including a visual deposit indicator of the present invention with the visual indicator in the activated position.

A back view of the mailbox including the visual deposit indicator 10 with the visual signaling device 28 in the activated position is illustrated in FIG. 5. From this view it can be seen that the visual signaling device 28 may include a message 54 indicating that an item such as mail has been placed in the mailbox. A recess 56 is also positioned to extend through the visual signaling device 28 for receiving the rod 40 therethrough when the visual signaling device 28 is positioned in the inactive position. The position of the visual signaling device 28 in the inactive position is shown in dashed lines. The movement of the rod 40 to place the visual signaling device in the activated position is indicated by the arrow labeled 58.

The recess 56 extending through the visual signaling device 28 is illustrated for purposes of example only and not meant to limit the invention in any manner. While a preferred mechanism for engaging the rod is shown and described herein, those of ordinary skill in the art who have read the description will appreciate that there are numerous other mechanisms for engaging the rod and, therefore, as used herein the phrase "means for engaging the rod" should be construed as including all such mechanisms as long as they achieve the desired result of engaging the rod, and, therefore, that all such equivalent mechanisms are to be considered as equivalents to the one described herein.

Figure 6:
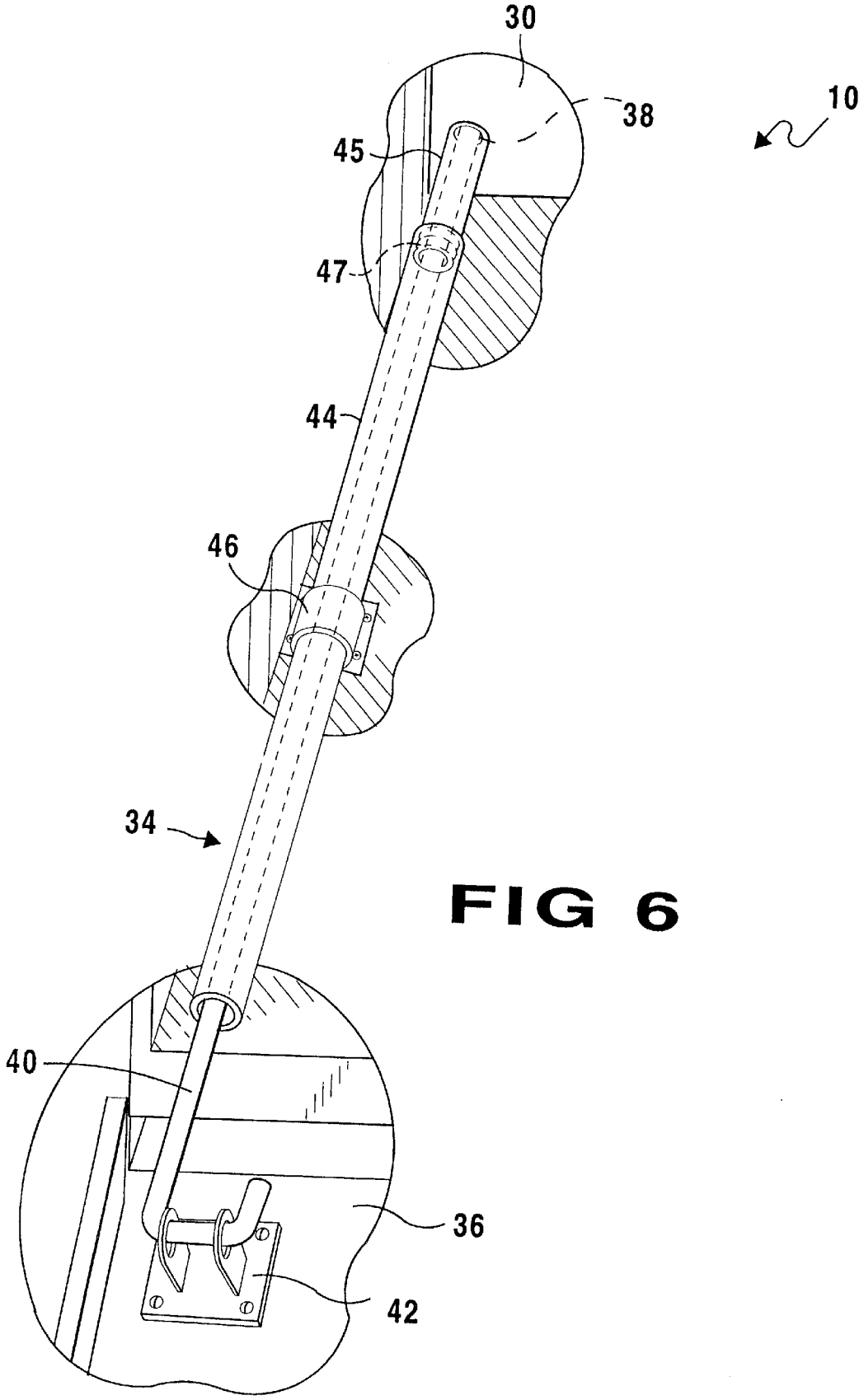
FIG. 6 is an enlarged top perspective view of the activation mechanism for the mailbox including a visual deposit indicator of the present invention.

An enlarged view of the activation mechanism 34 is illustrated in FIG. 6. From this view the connection of the fastening device 42 to the inner side 36 of the door 14 is clearly illustrated. The fastening device 42 is secured to the rod 40 causing the rod 40 to move with the pivoting of the door 14 and the fastening device. The rod 40 extends through the inner side 32 of the housing 12 and the recess 38 in the back side of the housing 12. The rod cover 44 is secured within the housing 12 by the securing device 46 and is connected to the rod guide 45. The rod guide 45 is secured at an end opposite the connection to the rod cover 44 to the back side 30 and surrounding the recess 38. The rod 40 is positioned to extend through the rod cover 44 and rod guide 45 being slideable therethrough. When the front door 14 is opened and thereby pivoted away from the housing 12, the rod 40 is caused to slide within the rod cover 44 and rod guide 45 and is pulled out of the inner side 32 of the housing 12. This causes the rod 40 to pass back through the recess 38 and break the engagement with the visual signaling device 28 positioned outside the housing 12.

The operation of the mailbox including the visual deposit indicator 10 will now be described with reference to the figures. In operation, the mailbox including the visual deposit indicator 10 is placed in the inactivated position by manually pivoting the visual signaling device 28 into a position between the back side 30 of the housing 12 and the cover plate 22. The front door 14 is then pivoted to the closed position causing the rod 40 to be pushed through the recess 38, the rod 40 being held in alignment with the recess 38 by the rod guide 45. In this position the rod 40 is caused to engage the visual signaling device 28 and retain it in the inactivated position. The front door 14 is caused to remain in the closed position by the latching device formed by the first and second clasps 24 and 26, respectively. The visual signaling device 28 will remain in the inactivated position until the front door 14 is pivoted into the open position.

When someone desires to place an item in the mailbox, the front door 14 is grasped and a force is applied in a direction away from the housing 12. This causes the front door 14 to pivot into the open position. When the front door 14 is caused to pivot, the fastening device 42 and thus the rod 40 are caused to move with the front door 14. As the rod 40 moves with the front door 14 it is caused to be removed from extending through the recess 38 and is thus disengaged from the visual signaling device 28. When the engagement between the rod 40 and visual signaling device 28 is broken the force of gravity causes the visual signaling device 28 to pivot about the second fastener 26 and come to rest in its activated position behind the mailbox. When a person views the visual signaling device 28 in this activated position he is alerted that the mailbox has been opened and a person has probably placed an item therein. The person may now retrieve the item placed within the mailbox and reset the visual indicator as described above.

The visual signaling device is preferably of a size large enough to be viewed from a great distance and thereby eliminate the need for a person having a mailbox a long distance from their residence to travel to the mailbox when there is nothing inside. A message is also preferably printed on the visual signaling device, the message being printed in large easily readable print and using a substance which can be readily seen through bad weather such as fog or at night such as a luminescent material. The visual signaling device is furthermore preferably formed from one of plastic, Lucite, any polymeric material, iron, steel, any metal, any metallic alloy or any combination thereof.

From the above description it can be seen that the mailbox including a visual deposit indicator of the present invention is able to overcome the shortcomings of prior art devices by providing a mailbox including a visual deposit indicator which is able to alert an owner of the mailbox that the mailbox has been opened to place an item therein the visual indicator activating automatically upon opening of a door to the mailbox. The mailbox including a visual deposit indicator includes the visual indicator positioned to extend from a rear side of the mailbox and is activated by the force of gravity. The mailbox including a visual deposit indicator is also able to be viewed from a great distance. Furthermore, the mailbox including a visual deposit indicator of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A mailbox including a visual signaling device for alerting a user that said mailbox has been opened, said mail box comprising:

a) a housing having a hollow inner side, a closed back side, and an open face side;

b) a door pivotally connected to said housing for selectively covering said open face side;

c) said visual signaling device pivotally connected to said housing on an external side of said closed back side opposite said door;

d) means extending through said inner side of said housing and fastened to and movable with said door for releasably engaging said visual signaling device comprising a rod pivotally attached at one end to said door and engaged with said visually signaling device at the other end of said rod so that the opening of said door moves said rod out of engagement with said visually signaling device permitting said device to drop;

e) a stationary cylindrical rod cover mounted within said housing and a cylindrical rod guide fixed at one end to said back side and threadably engaged at the opposite end to said rod cover, said rod passing and sliding through said rod cover and guide, and a recess in said back side aligned with said rod guide to permit said rod to extend out said back side;

f) a rectangular cover plate mounted on the external side of and spaced from said closed back side supported by first and second fasteners, said first fastener being on a top corner of said plate and said second fastener being on a corner below said top corner;

g) said visual signaling device comprising a flat member pivoted on said second fastener between said cover plate and said closed back side and having a recess lined up with said rod when said flat member is in an inactive position between said cover plate and said back side, said rod passing through said flat member recess when said door is closed to retain said flat member in said inactive position, the opening of said door pulling said rod out of the recess in said flat member permitting said flat member to pivot by gravity about said second fastener and drop into an activated position where said flat member is visible from the back side of said mailbox; and h) a side of said flat member facing away from said housing containing a message in luminescent material indicating the presence of mail, said message being hidden by said cover plate when said flat member is in said inactive position.

2. The mailbox including said visual signaling device as recited in claim 1, wherein said visual signaling device is formed from one of plastic, Lucite, any polymeric material, iron, steel, any metal, any metallic alloy or any combination thereof.

* * * * *